United States Patent [19]

Aeppli

[11] 4,007,457

[45] Feb. 8, 1977

[54] METHOD OF AND APPARATUS FOR DETECTING FAULTS IN THE OPERATION OF OPEN-END SPINNING MACHINES

[75] Inventor: Kurt Aeppli, Uster, Switzerland

[73] Assignee: Zellweger, Ltd., Switzerland

[22] Filed: Jan. 24, 1975

[21] Appl. No.: 544,005

[30] Foreign Application Priority Data

Feb. 8, 1974 Switzerland ..... 1739/74

[52] U.S. Cl. ..... 340/259; 19/.23; 57/81; 66/163; 73/160; 242/36

[51] Int. Cl.[2] ..... G08B 21/00

[58] Field of Search ..... 340/259; 28/64; 66/163; 19/.23; 57/81; 73/160; 242/36

[56] References Cited

UNITED STATES PATENTS

| | | | |
|---|---|---|---|
| 3,053,986 | 9/1962 | Loepfe et al. | 28/64 |
| 3,106,762 | 10/1963 | Riera | 340/259 |
| 3,264,922 | 8/1966 | Peyer | 28/64 |
| 3,408,560 | 10/1968 | Felix et al. | 28/64 |
| 3,440,634 | 4/1969 | Maurmann et al. | 340/259 |
| 3,731,069 | 5/1973 | Goto et al. | 340/259 |
| 3,756,524 | 9/1973 | Felix | 340/259 |

*Primary Examiner*—Glen R. Swann, III
*Attorney, Agent, or Firm*—Craig & Antonelli

[57] ABSTRACT

Faults in produced yarn occurring by fouling of spinning units can be detected by measuring changes in the cross-sectional diameter of the yarn and producing a control signal indicating irregularities. The apparatus of this invention includes a measuring device for measuring the cross-sectional diameter and producing a signal representative thereof, which signal is processed in a discriminator circuit, including at least a correcting circuit with a non-linear characteristic, an integrating circuit and a comparison circuit to compare the integrated signal with a predetermined standard, thereby producing the control signal.

38 Claims, 19 Drawing Figures

METHOD OF AND APPARATUS FOR DETECTING FAULTS IN THE OPERATION OF OPEN-END SPINNING MACHINES

BACKGROUND OF THE INVENTION

This invention relates to a method of, and apparatus for, detecting faults in the operation of spinning units in open-end spinning machines.

Open-end spinning machines are widely used in the textile industry. The spinning units of such machines are directly fed by a sliver. At the input end of the unit, there is an opener which breaks up the sliver into individual fibres which subsequently pass into a turbine rotating at high speed where they are placed one on top of the other in a groove under the effect of centrifugal force.

This assemblage of fibres is run-off at the center of rotation of the turbine, a heavy twist being imparted to it. The finished yarn is obtained in this way. It travels through a pair of rollers consisting of a driven roller and of a contact pressure roller. The speed of rotation of these rollers determines the take-off speed of the yarn. The yarn is then wound into packages, or yarn cheeses.

The actual spinning unit is in the form of a compact, encased unit between the point at which the sliver enters and the point at which the yarn leaves the turbine. These spinning units are normally in operation day and night. Under normal working conditions, only a few personnel are required for monitoring purposes, for example one person for every 1000 spinning units.

Nevertheless, disturbances which cannot readily be detected from outside can affect individual spindles over a period of time. For example, fibres and dirt can accumulate in the opener section. After reaching a certain size, these accumulations of fibres and dirt drop off and, hence, give rise to whole chains of faults in the yarn. Depending upon their size and nature, these yarn faults can give rise to distrubances either individually or when they appear repeatedly at short intervals, i.e. in chains in the yarn. Another type of fault is produced when fibres or dirt accumulate on the periphery of the turbine. This disturbs the uniform deposition of the individual fibres and produces more or less periodic, abnormally large fluctuations in the thickness of the yarn. There are also other factors which can cause faults in yarn.

However, one feature common to all these faults is that they are more troublesome, the greater the frequency with which they occur and/or the larger they are in size.

The defective operation of any one individual spinning unit is not necessarily attributable to a fault in that unit as it can also be caused by the material delivered to the unit. In many cases, the fault can be eliminated simply by cleaning the unit. In other cases, accumulations of dirt are automatically ejected after a certain time, leaving the unit to function correctly again.

Another feature of open-end spinning machines is that the yarn is wound directly into cheeses. The yarns are further processed in this form. Accordingly, the yarn is not subjected to any rewinding process to allow quality inspection and/or cleaning of the yarn.

If, during production, a spinning unit produces defective yarn over a prolonged period without this being noticed, heavy additional costs can be incurred during weaving or knitting due to the irregular appearance of the woven or knitted article, even in cases where only one among hundreds of cheeses has a fault of this kind.

It is therefore essential to take measures to prevent individual spinning units from producing defective yarn, even temporarily, during the production process. When a fault of this kind occurs, an alarm signal should be given and/or the spinning unit switched off.

SUMMARY OF THE INVENTION

An object of the present invention is to solve this problem. The invention provides a method of detecting the defective operation of spinning units in open-end machines, more especially for detecting disturbances attributable to fouling of the unit, distinguished by the fact that the cross-section or diameter of the yarn is measured between the point at which the yarn leaves a turbine of the machine and the point at which it runs onto a package and the measurement is converted into an electrical signal which is examined for irregularities emanating from the aforementioned disturbances, another signal being released when irregularities of this kind occur.

The invention also relates to an apparatus for carrying out this method, the said apparatus comprising, a measuring head between the point at which the yarn leaves the turbine and the point at which it is wound onto the cheese, the measuring head being arranged to measure the cross-section or diameter of yarn passing through it and to convert the measurement into an electrical signal, and a discriminator which is responsive to irregularities produced in the signal to said disturbances to release another signal.

BRIEF DESCRIPTION OF THE DRAWINGS

The invention will now be described by way of example with reference to the accompanying drawings, wherein.

DESCRIPTION OF THE PREFERRED EMBODIMENTS

Figure 1:
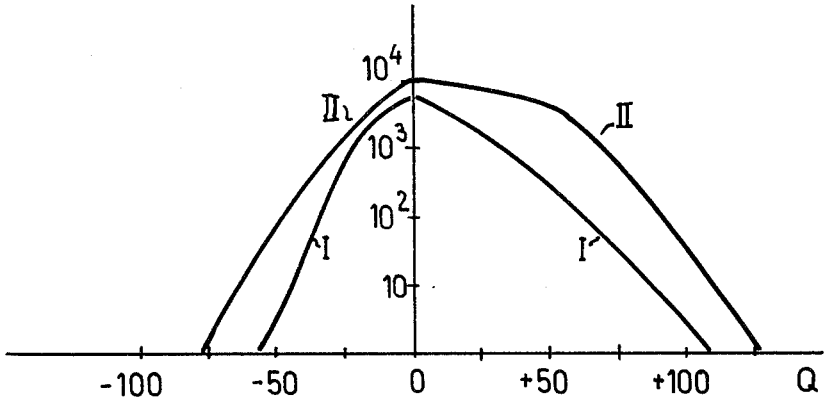
FIG. 1 is a frequency distribution diagram of cross-sections of two yarns of different quality, describing aspects of the present invention.

FIG. 1 shows the accumulative frequency distribution of yarn cross-section for two yarns of different quality. The values of the scale Q represents the deviations in percent of the average cross-section, while the values on the ordinate designate the corresponding accumulative frequencies on a logarithmic scale.

The curve designated by I is the characteristic of a yarn of average quality, while the curve II is the characteristic of a yarn with a considerably larger number of cross-sectional deviations from the average value and with greater cross-sectional deviations. The hump in the range of + 50 to + 100 % Q in curve II is typical of a defective yarn spun on an open-end spinning machine, as compared with regular yarn in curve I. The object of the method according to the invention is to detect differences resulting from these characteristics and to enable appropriate measures to be taken on the basis of any differences detected.

Figure 2:
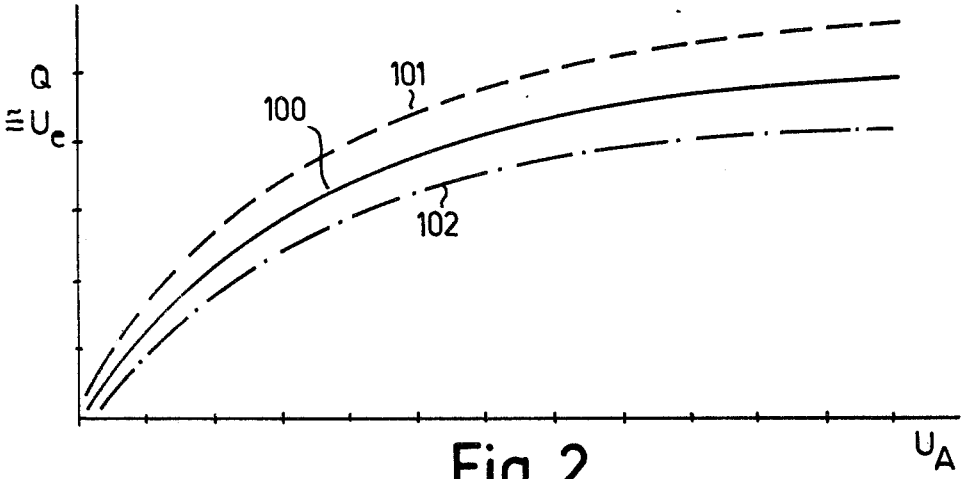
FIG. 2 is the characteristic curve for a correcting element providing non-linear analogue signal.

FIG. 2 shows a characteristic curve 100 of a correcting element for analogue signals with a non-linear characteristic of the kind used in the arrangement according to the invention. The output voltage $U_A$ increases proportionally relative to the input voltage. The curves represented by 101 and 102 are curves displaced in relation to the characteristic 100 to indicate that the transmission of the correcting element can be made variable.

Figure 3:
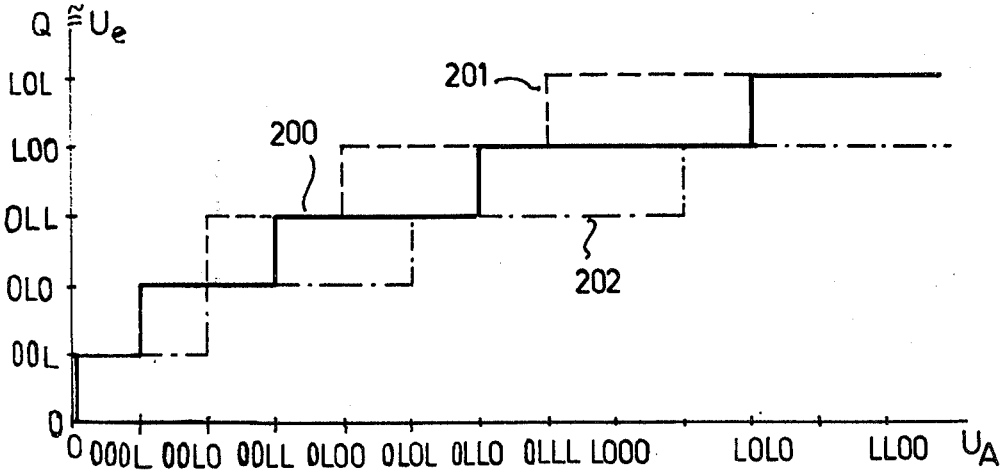
FIG. 3 is the characteristic curve for a correcting circuit providing non-linear digital signals, which can be used in the operation of this invention.

FIG. 3 shows a characterstic curve 200 of a correcting element with a non-linear characteristic for digital signals of the kind which can be used as a variant in an arrangement according to the invention. The curves 201 and 202 are again modified characteristics corresponding to the variability of the transmission values.

Figure 4:
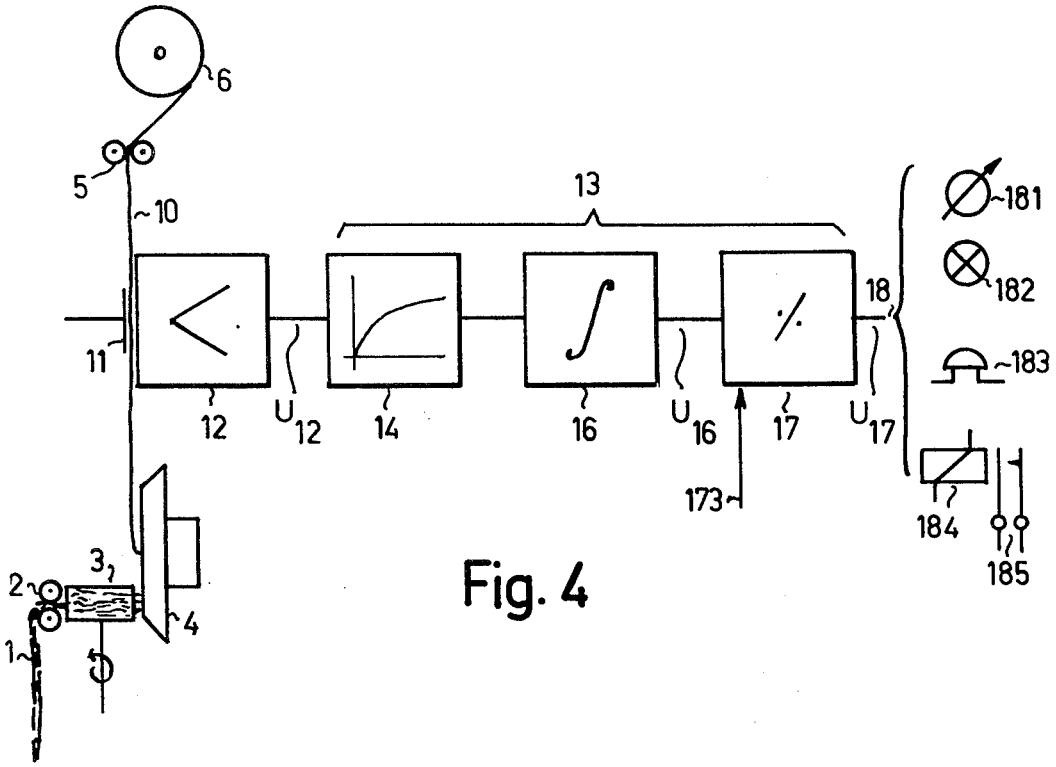
FIG. 4 illustrates a first embodiment of the invention in the form of a block circuit diagram.

The basic form of a complete arrangement is illustrated in the form of a block diagram in FIG. 4. The actual spinning unit of the open-end spinning machine in question comprises a pair of take-in rolls 2 with the sliver 1 delivered thereto, an opener 3 and a turbine 4. The spun yarn 10 leaves the turbine 4 at its center, is run-off by a pair of take-off rolls 5 and wound onto a cheese 6 or other package. A measuring element 11 is arranged between the point at which the yarn leaves the turbine 4 and the pair of take-off rolls 5 for measuring the cross-section or diameter of the yarn. The measuring element 11 cooperates with a measuring head 12 which contains the feed and amplifier elements required for producing a signal $U_{12}$ corresponding to the cross-section or diameter of the yarn. The measuring unit for measuring the cross-section of the yarn, formed by measuring element 11 and measuring head 12, may be of a conventional type, such as found in reissue Pat. No. Re 23,368 to Grob et al.

The signal $U_{12}$ from the measuring head 12 passes to a discriminator 13 in which it is examined for irregularities and from which an output signal $U_{17}$ is released in the event of any irregularities in the signal. This output signal $U_{17}$ passes to an indicator 18 in the form of, either individually or in combination, indicating instruments 181, signal lamps 182, alarm bells 183 or contactors or relays 184 with contact sets 185.

The discriminator 13 itself is made up of a correcting element 14 (see FIGS. 7*a* and 8*a*, for example) with a non-linear characteristic according to either FIG. 2 or FIG. 3, an integrator 16 and a comparator 17. In the comparator 17, the corrected and integrated signal $U_{16}$ is compared with a reference voltage delivered to the comparator through a line 173. When the signal $U_{16}$ exceeds the reference voltage to an unacceptable extent, a signal $U_{17}$ is formed, the indicator 18 responding to this signal.

The signal $U_{12}$ is initially influenced by the non-linear characteristic of the correcting element 14 in the sense that the large deviations from the average value of the yarn produce stronger output signals than would be the case with linear transmission. In the integrator 16, the amplitude-corrected signal is then examined for the frequency with which such signals occur.

The effect of this combination is that, on the one hand, the above-average cross-sections occurring in the vicinity of the "hump" in FIG. 1 are emphasized, although on the other hand integration requires a certain fequency with which above-average cross-sections of this kind occur to produce an output signal $U_{17}$.

This basic form of the arrangement according to the invention lends itself to various modification, each of which is able to satisfy particular requirements.

Figure 5:
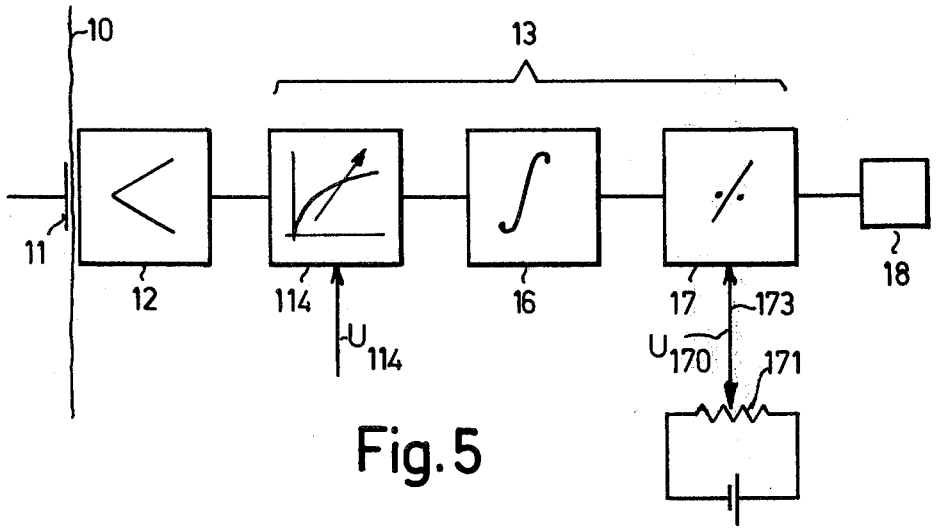
FIG. 5 illustrates an advantageous further development of the embodiment illustrated in FIG. 4.

FIG. 5 shows a discriminator 13 containing a correcting element 114 with a characteristic that can be controlled by a control voltage $U_{114}$ applied externally to the correcting element 114. The ideal value $U_{170}$, which is a reference voltage for a comparator 17, is shown as an individually adjustable voltage which is tapped from a potentionmeter 171 and applied through the line 173 to the comparator 17.

A problem that repeatedly arises, when working with the average value of the output signals $U_{16}$ of the integrator 16 and the deviations therefrom, is that this average value itself is not constant, but instead can vary over prolonged time intervals. This variation does not take the form of sporadic irregularities in this average value, instead it is a prolonged movement in one direction or the other.

Figure 6:
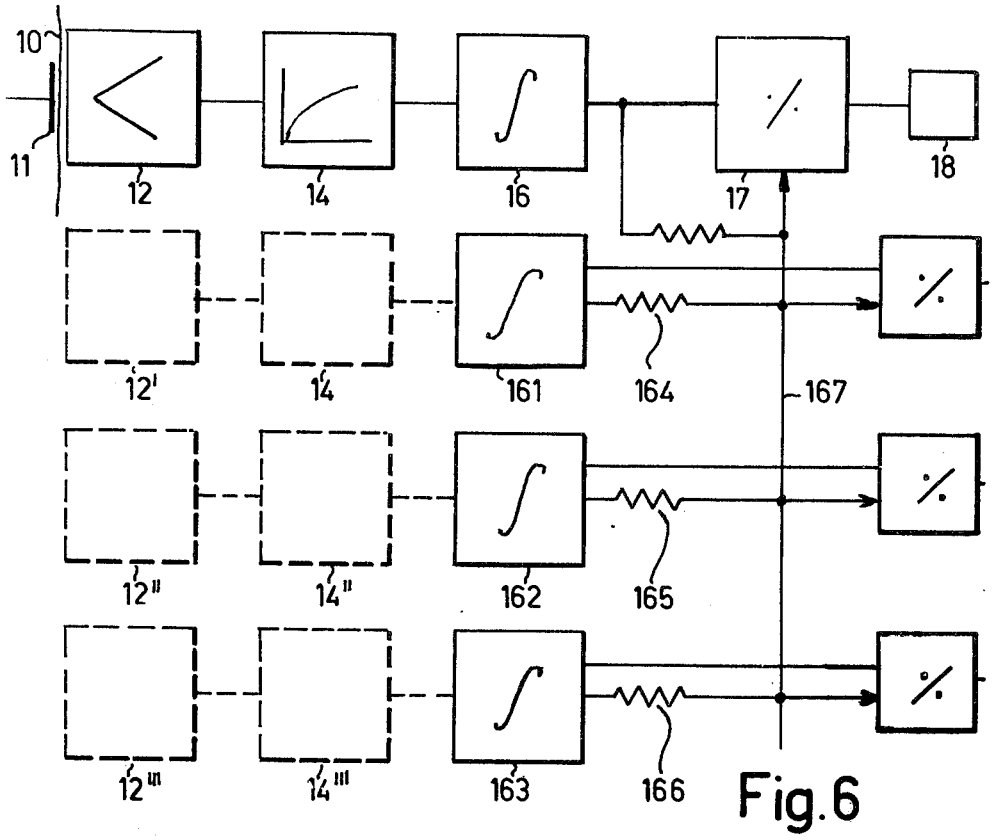
FIG. 6 illustrates a possible variant of the embodiment illustrated in FIG. 4.

A plurality of yarns are spun adjacent one another in spinning machines of the kind in question. Where each spinning unit is equipped with an arrangement according to the invention, there is an equally large number of integrator output values whose average value can be applied as the ideal value $U_{170}$ to the comparator of the spinning units. This is shown in FIG. 6. The integrators 161, 162, 163 . . . of a number of other discriminators 12', 14'; 12'', 14''; 12''', 14''', are connected through resistances 164, 165, 166 to a bus bar 167. This bus bar 167 assumes a potential corresponding to the average value of all the integrator signals $U_{16}$. Even when one or more of the integrators cooperating in this way show marked deviations from the average value, the ideal value $U_{170}$ is only affected to a negligible extent. It is only when all the integrator outputs tend in the same direction of a modified value that the ideal value $U_{170}$ is also changed.

Figure 7A:
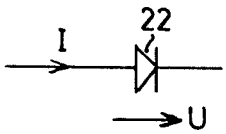
FIG. 7*a* illustrates a first circuit detail corresponding to FIG. 5.
Figure 7B:
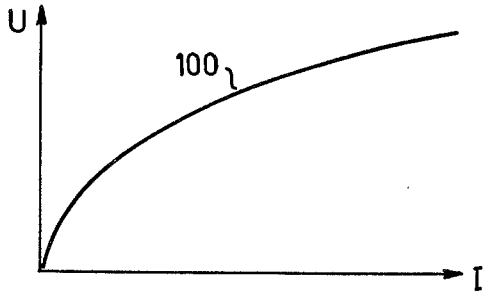
FIG. 7*b* illustrates a non-linear characteristic curve for the arrangement of FIG. 7*a*.

FIGS. 7*a* and 7*b* illustrate the basic element with which a non-linear characteristic can be obtained in the correcting element 14. The simplest element can be a diode 22. The current I increases substantially exponentially with increasing voltage U providing the diode is operated in the vicinity of the starting voltage.

Figure 8A:
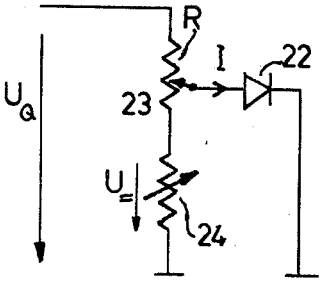
FIG. 8*a* illustrates a second circuit detail corresponding to FIG. 5, FIGS. 8*b* and 8*c* illustrate families of non-linear characteristic curves for an arrangement according to FIG. 8*a*.
Figure 8B:
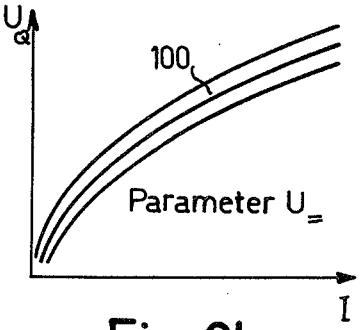
Figure 8C:
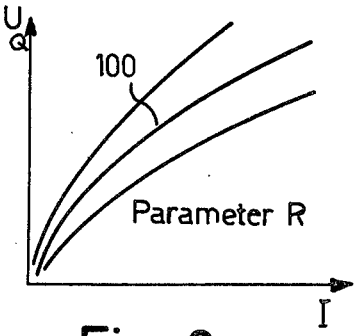

FIG. 8*a* shows a possibility of varying the diode characteristic curve according to FIG. 7*b*. The voltage $U_Q$ corresponding to the cross-section of the tested yarn is applied to a potentiometer 23, while the diode 22 is connected to the tap of th potentiometer 23. It is possible either to displace the characteristic curve 100 parallel to itself (FIG. 8*b*) by varying the voltage $U_=$ derived from the voltage $U_Q$ with the potentiometer 23 and a variable resistor 24, or to vary the steepness of the characteristic curves by adjusting the potentiometer 23 (FIG. 8*c*).

Figure 9:
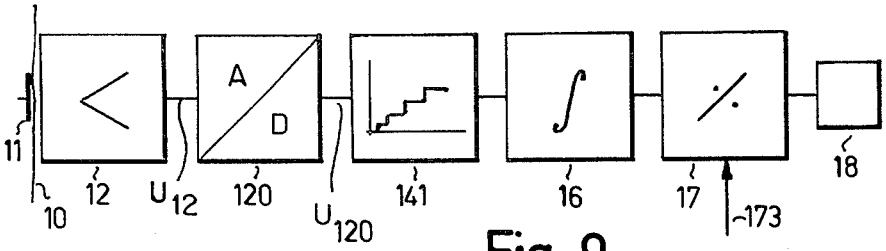
FIG. 9 illustrates a third possible variant of the embodiment illustrated in FIG. 4.

FIG. 9 illustrates one modification for further processing the signals $U_{12}$ in the form of digital signals. To this end, an analogue-digital converter 120 is arranged at the output of the measuring head 12, converting the analogue signals $U_{12}$ into digital values $U_{120}$. This analogue-digital converter 120 is followed by a correcting element 141 with a non-linear digital characteristic curve corresponding to the explanation of FIG. 3. However, the analogue-digital converter 120 can also be in the form of a converter with direct non-linear transmission. The other elements 16, 17 and 18 perform the same functions as those in FIG. 4, but are designed for processing digital signals.

Figure 10:
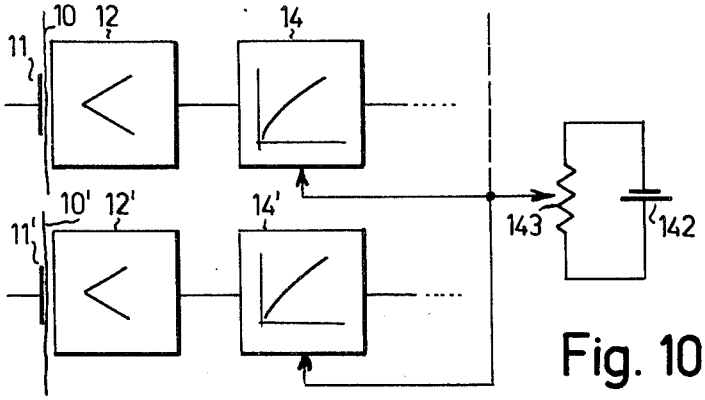
FIG. 10 illustrates an additional advantageous further development of the embodiment illustrated in FIG. 4.

In many cases, it is desirable or advisable for a plurality, i.e. at least two, of the arrangements according to the invention to be able to be adjusted in their properties from a central point. In this case, all the units connected to the central point can be varied at the same time and to the same extent, so that they always operate under the same conditions. One embodiment for this particular application is illustrated in FIG. 10. The correcting elements 14, 14' of two identical installations can be adjusted by means of a control voltage applied from outside. This control voltage is taken from a voltage source 142 and varied by means of a regulator 143, which may be a potentiometer tapping a part of the voltage of source 142. All the correcting elements 14 of the entire installation are then adjusted by this control voltage.

Figure 11:
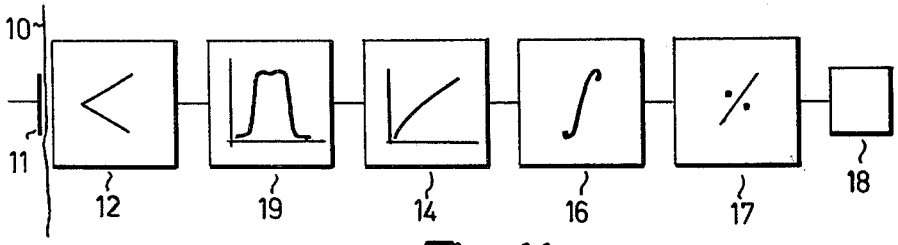
FIG. 11 illustrates a fourth variant of the embodiment illustrated in FIG. 4.
Figure 12:
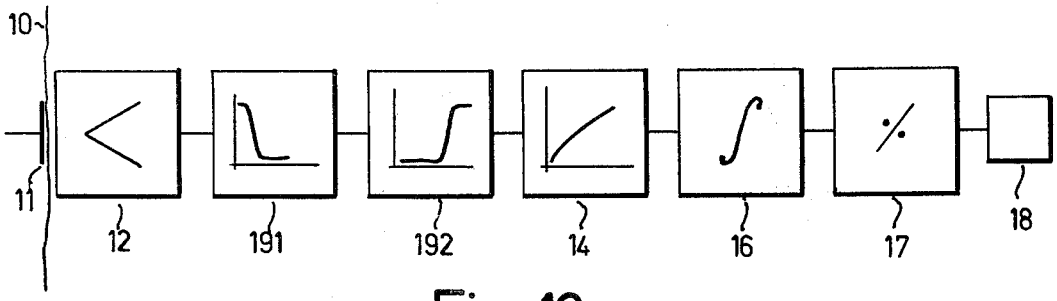
FIG. 12 illustrates one possible modified embodiment of the variant illustrated in FIG. 11.
Figure 13:
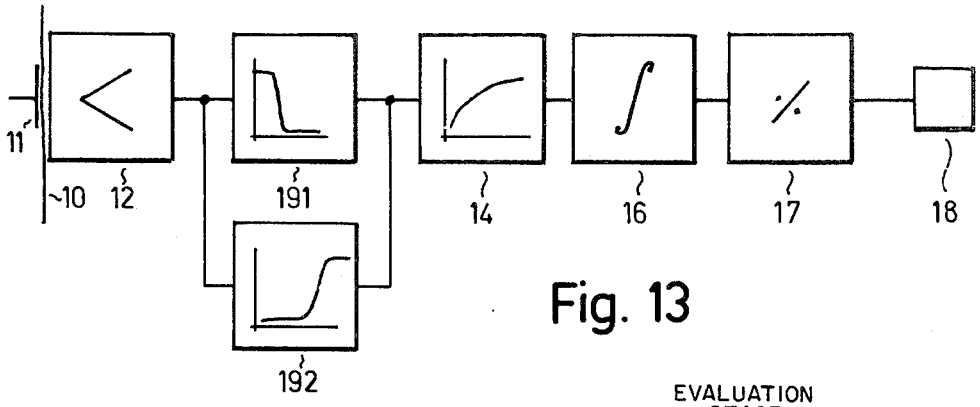
FIG. 13 illustrates another possible embodiment of the variant illustrated in FIG. 11.
Figure 14:
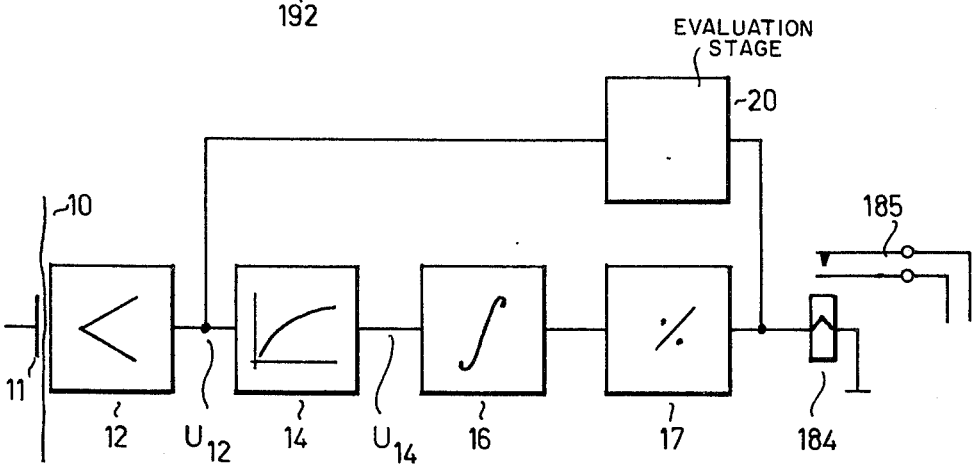
FIG. 14 illustrates the embodiment according to FIG. 4, additionally incorporating a detector for monitoring yarn travel.

Frequency-selective elements, such as band filters, high-pass filters, low-pass filters or the like, are incorporated between the measuring head 12 and the discriminator 13 in cases where a certain frequency range is to be emphasized and other frequency ranges suppressed from the signal $U_{12}$ before further processing in the discriminator 13. FIG. 11 shows a band filter 19 which prefers a certain frequency band in the signal $U_{12}$. The arrangement shown in FIG. 12 makes use of separate low-pass and high-pass filters 191, 192 in series, which is of advantage in cases where the limit frequencies are to be individually selected. According to FIG. 13, the low-pass filter 191 and high-pass filter 192 are connected in parallel between the measuring head 12 and the correcting element 14, which allows more combinations than a series circuit according to FIG. 12 in regard to the possible number of certain frequency ranges.

Figure 16:
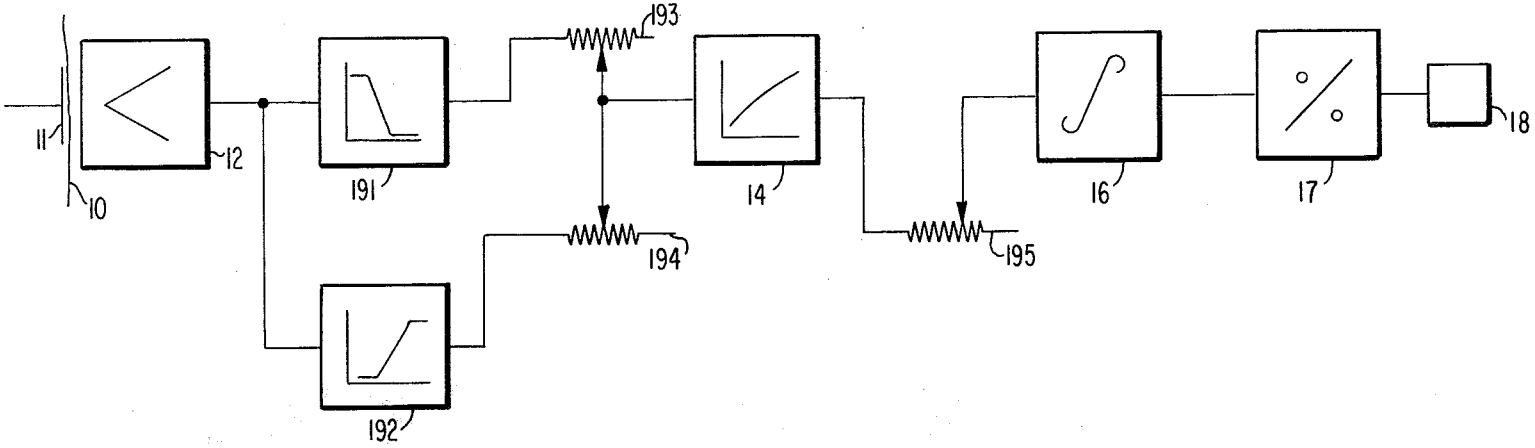
FIG. 16 illustrates a further embodiment of the arrangement of FIG. 12.

Because of the division of the discriminator 13 into elements which influence amplitude and/or frequency, it is also possible to allow the individual elements to participate to a different extent in the formation of the output signal $U_{17}$. Any one of a number of different ways of assessing properties of the tested yarn 10 can be selected in this way. For example, the output signals from the low and high pass filters 191 and 192 may be individually connected to potentiometers 193 and 194, respectively, as illustrated in FIG. 16, to provide different emphasis to these signals. In a like manner the output signal of the correcting element 14 can be adjusted by the potentiometer 195 to provide different emphasis to different components of the signal respresenting irregularities of different kinds.

The presence of yarn 10 in the measuring element 11 and a signal $U_{12}$ produced as a result also enables the arrangement according to the invention to be equipped with a means for monitoring yarn travel. To this end, the signal $U_{12}$ is also applied to an evaluation stage 20 which has to determine whether the signal $U_{12}$ contains an a.c. voltage component attributable to fluctuations in the cross-section of the yarn 10. The absence of this a.c. voltage component means that the yarn 10 is not moving in the measuring head 12. Accordingly, the evaluation stage 20 opens the contactor or relay 184 and initiates a suitable switching operation, such as switching the spinning unit off, by means of the contacts 185.

Figure 15:
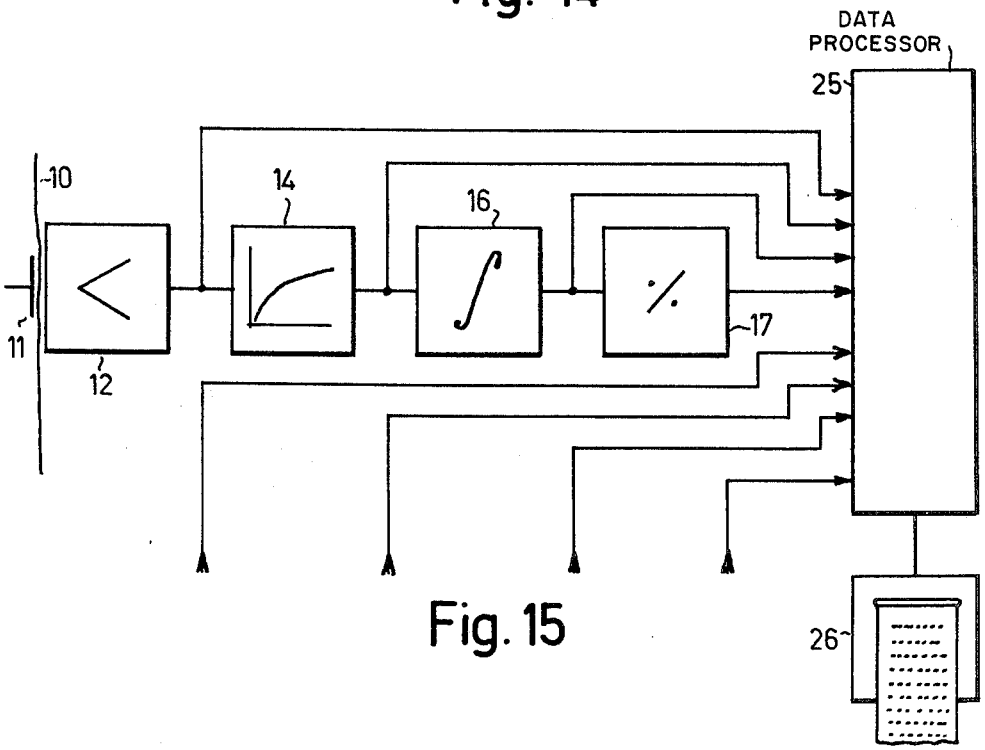
FIG. 15 illustrates the embodiment illustrated in FIG. 4 with a data-processing unit as the evaluation system.

Data-processing installations can also be used for particularly thorough investigations into the nature of the fluctuations in cross-section. FIG. 15 shows one possibility for this purpose. The electrical values, especially in digital form according to FIG. 9, from the individual elements, such as the measuring head 12, correcting element 14, integrator 16, and comparator 17 are transmitted from at least one installation to the data-processing system 25 where, after evaluation with a suitable program, they can be printed in legible form by a printer 26. This central data-processing facility can of course also extend over a number of evaluation units according to the present invention.

While I have shown and described several embodiments in accordance with the present invention, it is understood that the same is not limited thereto but is susceptibel of numerous changes and modifcations as known to those skilled in the art and I therefore do not wish to be limited to the details shown and described herein but intend to cover all such changes and modifications as are encompassed by the scope of the appended claims.

I claim:

1. A method of detecting the defective operation of spinning units in open-end spinning machines, especially disturbances attributable to fouling of the spinning units, which method comprises the steps of measuring the cross-section or diameter of yarn leaving at least one spinning unit, converting the measurement into an electrical signal, and processing said electrical signal in a discriminator to detect irregularities in said measurement by applying a non-linear correcting characteristic to said signal, integrating the corrected signal in an integrator, and comparing the integrated signal with a predetermined reference signal in a comparator, thereby generating a control signal upon the occurrence of said irregularities, wherein said predetermined reference signal is formed from the average value of the output signals of at least two of said integrators, each of which is associated with a different spinning unit.

2. A method of detecting the defective operation of spinning units in open-end spinning machines, especially disturbances attributable to fouling of the spinning units, which method comprises the steps of measuring the cross-section or diameter of yarn leaving at least one spinning unit, converting the measurement into an electrical signal, and processing said electrical signal in a discriminator to detect irregularities in said measurement by applying a non-linear correcting characteristic to said signal by a correcting means, integrating the corrected signal in an integrator, and comparing the integrated signal with a predetermined reference signal in a comparator, thereby generating a control signal upon the occurrence of said irregularities, wherein periodically recurring changes in yarn cross-section are detected by frequency-selective filters as irregularities in said electrical signal, and wherein said electrical signal having said irregularities is applied to the input of the correcting means by parallel connection of high-pass and low-pass frequency-selective filters to said correcting means to select only frequencies above the cut-off of said high-pass filter and below the cut-off of said low-pass filter, and suppress all frequencies therebetween.

3. A method as claimed in claim 2, wherein irregularities of different kinds are present as separate components of said electrical signal, the separate components being further processed with different emphasis.

4. An apparatus for detecting the defective operation of spinning units in open-end spinning machines, especially disturbances attributable to fouling of the spinning units, said apparatus comprising measuring means for generating an electrical signal representative of the cross-sectional diameter of yarn passing from at least one spinning unit, and discrimator means connected to said measuring means for generating a control signal in response to irregularities in said electrical signal, said irregularities being representative of excessive variations in said cross-sectional diameter, wherein said discriminator means includes at least one correcting circuit means with a non-linear characteristic for applying said non-linear characteristic to said electrical signal, an integrator circuit means connected to said correcting circuit means for integrating the corrected signal, and a comparison circuit means connected to said integrator circuit means for comparing the integrated signal with a predetermined reference signal, wherein said discriminator means further includes at least one frequency-selective filter means for determining frequency components of said electrical signal, and wherein said frequency-selective filter means include high-pass and low-pass frequency-selective filters connected in parallel to said correcting circuit means to select only frequencies above the cut-off of said high-pass filter and below the cut-off of said low-pass filter, and suppress all frequencies therebetween.

5. An apparatus as claimed in claim 4, wherein components of the input signal applied to sid integrator circuit means are individually adjustable or weighted, said components being formed by said correcting circuit means and said frequency-selective filter means.

6. An arrangement for detecting the defective operation of spinning units in open-end spinning machines, especially disturbances attributable to fouling of the spinning units, said apparatus comprising measuring means for generating an electrical signal representative of the cross-sectional diameter of yarn passing from at least one spinning unit, and discriminator means connected to said measuring means for generating a control signal in response to irregularities in said electrical signal, said irregularities of excessive variations in said cross-sectional diameter, wherein sid discriminator means includes at least one correcting circuit means with a non-linear characteristic for applying said non-linear characteristic to said electrical signal, an integrator circuit means connected to said correcting circuit means for integrating the corrected signal, and a comparison circuit means connected to said integrator circuit means for comparing the integrated signal with a predetermined reference signal, and wherein said predetermined reference signal is provided by the outputs of at least two of said integrator circuit means connected in parallel.

7. A method of detecting the defective operation of spinning units in open-end spinning machines comprising the steps of measuring the cross-section or diameter of yarn leaving at least one spinning unit, converting the measurement into an electrical signal, and processing said electrical signal in a discriminator to detect irregularities in said measurement by applying a non-linear characteristic to said electrical signal with a correcting device receiving said electrical signal to provide a corrected signal which emphasizes larger deviations of said cross-section or diameter of said yarn over smaller deviations thereof, integrating said corrected signal in an integrator connected to said correcting device to determine the frequency of occurrence of said larger deviations of said yarn, and comparing the integrated signal with a predetermined reference signal in a comparator connected to said integrator, thereby generating a control signal upon the occurrence of predetermined deviations of said cross-section or diamter of said yarn.

8. A method as claimed in claim 7, wherein said non-linear characteristic is adjustable.

9. A method as claimed in claim 7, wherein said predetermined reference signal is adjustable.

10. A method as claimed in claim 9, wherein said predetermined reference signal is simultaneously adjusted for at least two spinning units.

11. A method as claimed in claim 7, wherein said predetermined reference signal is formed from the average value of the output signals of at least two of said integrators, each of which is associated with a different spinning unit.

12. A method as claimed in claim 7, wherein said electrical signal is obtained as an analogue value, converted into a digital signal in an analogue-digital converter receiving said electrical signal and connected to the input of said correcting device, and processed as a digital signal in said correcting device, said integrator and said comparator.

13. A method as claimed in claim 7, wherein periodically recurring changes in yarn cross-section are detected by frequency-selective filters as irregularities in said electrical signal.

14. A method as claimed in claim 13, wherein said electrical signal having said irregularities is applied to the input of said correcting device with a series connection of said frequency-selective filters.

15. A method as claimed in claim 14, wherein irregularities of different kinds are present as separate components of said electrical signal, the separate components being further processed with different emphasis, said different emphasis being selected by the choise of said frequency-selective filters.

16. A method as claimed in claim 13, wherein said electrical signal having said irregularities is applied to the input of said correcting device by parallel connection of high-pass and low-pass frequency-selective filters to said correcting device to select only frequencies above the cut-off of said high-pass filter and below the cut-off of said low-pass filter, and suppress all frequencies therebetween.

17. A method as claimed in claim 16, wherein irregularities of different kinds are present as separate components of said electrical signal, the separate components being further processed with different emphasis.

18. A method as claimed in claim 7, wherein said electrical signal provides a second control signal for monitoring yarn travel, the spinning unit being swtiched off in the absence of said additional control signal.

19. A method as claimed in claim 7, wherein said electrical signal and the processed signals are applied to a central data-processing facility for further evaluation of the operation of the spinning unit.

20. An apparatus for detecting the defective operation of spinning units in open-end spinning machines comprising measuring means for generating an electrical signal representative of the cross-section or diameter of yarn passing from at least one spinning unit, and discriminator means connected to said measuring means for generating a control signal in response to irregularities in said electrical signal, said irregularities being representative of excessive deviations in said cross-section or diameter of said yarn, and said discriminator means including at least one correcting circuit means receiving said electrical signal for applying a non-linear characteristic to said electrical signal to provide a corrected signal which emphasizes larger deviations of said cross-section or diameter of said yarn over smaller deviations thereof, integrator circuit means connected to said correcting circuit means for integrating the corrected signal to determine the frequency of occurrence of said larger deviations of said yarn, and comparison circuit means connected to said integrator circuit means for comparing the integrated signal with a predetermined reference signal to generate said control signal upon the occurrence of predetermined deviations of said cross-section or diameter of said yarn.

21. An apparatus as claimed in claim 20, wherein said correcting circuit means is connected to the output of said measuring means.

22. An apparatus as claimed in claim 20, wherein said correcting circuit means provides said corrected signal with an at least substantially exponential characteristic.

23. An apparatus as claimed in claim 20, wherein said correcting circuit means are adjustable to vary the non-linear characteristic applied to said electrical signal.

24. An apparatus as claimed in claim 20, wherein said non-linear characteristic of at least two discriminator means is adjustable from a central point.

25. An apparatus as claimed in claim 20, wherein said correcting circuit means includes non-linear elements for providing said non-linear characteristic, and non-linear elements including at least one of a semiconductor and a variable resistor.

26. An apparatus as claimed in claim 20, wherein the non-linear characteristic of the correcting circuit means is produced by a diode.

27. An apparatus as claimed in clain 20, wherein said correcting circuit means are preceded by an analogue-digital conversion means for producing digital signals corresponding to said electrical signal, said digital signals being processed by said discriminator means.

28. An apparatus as claimed in claim 20, wherein discriminator means further includes at least one frequency-selective filter means connected to said measuring means for determining frequency components of said electrical signal.

29. An apparatus as claimed in claim 28, wherein said frequency-selective filter means include frequency-selective filters connected in series with said correcting circuit means.

30. An apparatus as claimed in claim 29, wherein components of the input signal applied to said integrator circuit means are individually adjustable or weighted, said components being formed by said correcting circuit means and said frequency-selective filter means, the individual adjusting or weighting being selected by the choise of said frequency-selective filters.

31. An apparatus as claimed in claim 28, wherein said frequency-selective filter means includes high-pass and low-pass frequency-selective filters connected in parallel to said correcting circuit means to select only frequencies above the cut-off of said high-pass filter and below the cut-off of said low-pass filter, and suppress all frequencies therebetween.

32. An apparatus as claimed in claim 31, wherein components of the input signal applied to said integrator circuit means are individually adjustable or weighted, said components being formed by said correcting circuit means and said frequency-selective filter means.

33. An apparatus as claimed in claim 20, wherein at least said control signal of the discriminator means is applied to central data-processing facilities for evaluating said irregularities.

34. An arrangement as claimed in claim 20, wherein said predetermined reference signal is provided by the outputs of at least two of said integrator circuit means connected in parallel.

35. An apparatus as claimed in claim 20, wherein said predetermined reference signal is adjustable.

36. An apparatus as claimed in claim 20, further comprising at least one of an acoustic and optical warning system, said warning system being actuated by said control signal.

37. An apparatus as claimed in claim 20, wherein a switch means for turning off the spinning unit is controlled by said control signal.

38. An apparatus as claimed in claim 20, wherein said electrical signal provides a yarn-monitoring signal, said yarn-monitoring signal being applied to a switch means for turning off the spinning unit.

* * * * *